US010253442B2

(12) United States Patent
Lee et al.

(10) Patent No.: US 10,253,442 B2
(45) Date of Patent: Apr. 9, 2019

(54) TOP-LOADING TYPE WASHING MACHINE

(71) Applicant: LG ELECTRONICS INC., Seoul (KR)

(72) Inventors: Sangjun Lee, Seoul (KR); Youngjong Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 256 days.

(21) Appl. No.: 14/845,694

(22) Filed: Sep. 4, 2015

(65) Prior Publication Data

US 2016/0069011 A1 Mar. 10, 2016

(30) Foreign Application Priority Data

Sep. 5, 2014 (KR) ..... 10-2014-0119169
Sep. 5, 2014 (KR) ..... 10-2014-0119170
Dec. 16, 2014 (KR) ..... 10-2014-0181550

(51) Int. Cl.
*D06F 37/24* (2006.01)
*D06F 37/26* (2006.01)

(52) U.S. Cl.
CPC ..... *D06F 37/245* (2013.01); *D06F 37/267* (2013.01)

(58) Field of Classification Search
CPC ..... D06F 23/04; D06F 37/24; D06F 37/245; D06F 37/206; D06F 37/26; D06F 37/264; D06F 37/265; D06F 37/267
See application file for complete search history.

(56) References Cited

U.S. PATENT DOCUMENTS

2008/0282747 A1* 11/2008 Kim ..... D06F 37/065 68/13 R
2011/0083478 A1* 4/2011 Silva ..... D06F 37/28 68/200
2015/0121968 A1* 5/2015 Kim ..... D06F 37/24 68/23.2

FOREIGN PATENT DOCUMENTS

| | | |
|---|---|---|
| CN | 1150610 | 5/1997 |
| CN | 1160099 | 9/1997 |
| CN | 1600956 | 3/2005 |
| CN | 1650062 | 8/2005 |
| CN | 1690292 | 11/2005 |
| CN | 102362027 | 2/2012 |
| KR | 10-1997-0011125 | 3/1997 |
| KR | 20-1998-0032710 | 9/1998 |
| KR | 20-0134130 | 4/1999 |

(Continued)

OTHER PUBLICATIONS

Machine Translation of KR20110051017A (Year: 2011).*

(Continued)

*Primary Examiner* — Spencer E Bell
(74) *Attorney, Agent, or Firm* — Fish & Richardson P.C.

(57) ABSTRACT

Disclosed herein is a top-loading type washing machine which includes a drum including a drum body opened at upper and lower sides thereof, and a drum base coupled to the lower side of the drum body, a hub fixed to the drum base, an upper balancer installed to the drum body, for reducing vibrations generated when the drum rotates, and a lower balancer fixed to one of the hub and the drum base, for reducing vibrations generated when the drum rotates. The top-loading type washing machine can effectively remove eccentricity or vibrations generated during the rotation of the drum, since the lower balancer is installed at the lower side of the drum.

8 Claims, 25 Drawing Sheets

(56) References Cited

FOREIGN PATENT DOCUMENTS

| | | |
|---|---|---|
| KR | 10-2011-0051017 | 5/2011 |
| KR | 10-2012-0035700 | 4/2012 |

OTHER PUBLICATIONS

International Search Report and Written Opinion in International Application No. PCT/KR2015/009389, dated Jan. 4, 2016, 16 pages.
Office action in Chinese Application No. 201580060227.8, dated Sep. 4, 2018, 18 pages (with English Translation).

* cited by examiner

TOP-LOADING TYPE WASHING MACHINE

CROSS-REFERENCE TO RELATED APPLICATION

This application claims the priority benefit of Korean Patent Application No. 10-2014-0119169, filed on Sep. 5, 2014, Korean Patent Application No. 10-2014-0119170 filed on Sep. 5, 2014 and Korean Patent Application No. 10-2014-0181550 filed on Dec. 16, 2014 in the Korean Intellectual Property Office, the disclosure of which is incorporated herein by reference.

BACKGROUND OF THE INVENTION

1. Field of the Invention

The present invention relates to a top-loading type washing machine.

2. Description of the Related Art

In general, washing machines are apparatuses for washing objects to be washed (hereinafter, referred to as "laundry") using emulsifying action of detergent, water stream action generated by the rotation of a washing container or washing blades, impact action applied to the washing blades, etc. Washing machines performs processes such as washing, rinsing, and dehydration, so as to remove contaminants from laundry using the interaction between detergent and water.

Washing machines are classified into a top-loading type washing machine and a front-loading type washing machine according to the position of an insertion port for inserting laundry. The top-loading type washing machine has an insertion port in the vertical direction, and the front-loading type washing machine has an insertion port in the front-to-back direction.

A conventional top-loading type washing machine includes a tub which stores wash water, a drum which is arranged in the tub to accommodate and wash laundry, and a motor device which is disposed at the lower portion of the tub to rotate the drum.

Here, the upper portion of the drum is equipped with a hydraulic balancer for reducing vibrations which are generated due to the imbalance of laundry.

However, since the conventional top-loading type washing machine includes a hydraulic balancer which is disposed only at the upper portion of the drum, vibrations generated by the drum may not be effectively reduced.

[Patent Document] Korean Patent No. 10-0332761

SUMMARY OF THE INVENTION

Therefore, the present invention has been made in view of the above problems, and it is an object of the present invention to provide a top-loading type washing machine including balancers which are respectively disposed at upper and lower sides of a drum.

It is another object of the present invention to provide an optimized installation structure and shape of a lower balancer which is disposed at a lower side of a drum.

In accordance with an aspect of the present invention, the above and other objects can be accomplished by the provision of a top-loading type washing machine including a drum including a drum body opened at upper and lower sides thereof, and a drum base coupled to the lower side of the drum body, a hub fixed to the drum base, an upper balancer installed to the drum body, for reducing vibrations generated when the drum rotates, and a lower balancer fixed to the hub, for reducing vibrations generated when the drum rotates.

The top-loading type washing machine may further include a hub fixing portion formed at the hub, and a balancer fixing portion formed at the lower balancer, and the hub fixing portion may be coupled to the balancer fixing portion.

The hub fixing portion may be coupled to the balancer fixing portion in a concave-convex form.

The balancer fixing portion may be located at a lower side of the hub fixing portion.

The balancer fixing portion, the hub fixing portion, and the drum base may be stacked in this order, and be fastened to one another in such a manner that a fastening member simultaneously passes through the balancer fixing portion, the hub fixing portion, and the drum base.

The lower balancer may include a balancer body, a balancer fixing portion formed at the balancer body while being fixed to the hub, a balancer portion disposed outside the balancer body while a mass is embedded in the balancer portion, and a storage space defined inside the balancer portion, the mass moving in the storage space.

The balancer portion may be located at a higher position than the hub.

The lower balancer may further include a balancer latch portion, the drum base may further include a base latch portion, and the balancer latch portion may be horizontally latched to the base latch portion.

The hub may further include a hub fixing portion fixed to the drum base, the lower balancer may further include a balancer fixing portion coupled to the hub fixing portion, and the balancer fixing portion may be inserted into and coupled to the hub fixing portion.

The hub may further include a hub fixing portion fixed to the drum base, the lower balancer may further include a balancer fixing portion coupled to the hub fixing portion, and the hub fixing portion may be inserted into and coupled to the balancer fixing portion.

The drum base may further include a balancer installation portion, the balancer installation portion may be located at a higher position than the hub, and the balancer portion may be located at the balancer installation portion.

In accordance with another aspect of the present invention, there is provided a top-loading type washing machine including a drum including a drum body opened at upper and lower sides thereof, and a drum base coupled to the lower side of the drum body, a hub fixed to the drum base, an upper balancer installed to the drum body, for reducing vibrations generated when the drum rotates, and a lower balancer fixed to the drum base, for reducing vibrations generated when the drum rotates.

The lower balancer may be located radially outwardly from the hub.

The lower balancer may include a balancer body, a balancer fixing portion formed at the balancer body while being fixed to the drum base, a balancer portion disposed outside the balancer body while a mass is embedded in the balancer portion, and a storage space defined inside the balancer portion, the mass moving in the storage space.

The balancer portion may be located at a higher position than the hub.

The lower balancer may further include a balancer latch portion, the drum base may further include a base latch portion, and the balancer latch portion may be horizontally latched to the base latch portion.

The lower balancer may further include a balancer latch portion, the drum base may further include a base latch portion, the balancer latch portion may be horizontally latched to the base latch portion, and at least a portion of the balancer latch portion may be vertically located between the hub and the drum base.

At least a portion of the balancer latch portion may be supported by an upper side surface of the hub.

The drum base may further include a balancer installation portion, the balancer installation portion may be located at a higher position than the hub, and the balancer portion may be located at the balancer installation portion.

The lower balancer may include a first balancer fixed to the drum base, for reducing vibrations generated when the drum rotates, and a second balancer detachably coupled to the first balancer, for reducing vibrations generated when the drum rotates.

The second balancer may be disposed radially outwardly from the first balancer.

The second balancer may be disposed at an upper or lower side of the first balancer.

The first balancer may have a first balancer connection portion, the second balancer may have a second balancer connection portion, and the first balancer may be coupled to the second balancer through the first and second balancer connection portions.

The first balancer connection portion may be fastened to the second balancer connection portion.

The first balancer connection portion may be hooked to the second balancer connection portion.

The first and second balancer connection portions may be disposed radially from a rotary shaft of the drum.

The drum base may further include a balancer installation portion protruding upward, the balancer installation portion may be located at a higher position than the hub, and at least one of the first and second balancers may be disposed at the balancer installation portion.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE PREFERRED EMBODIMENTS

Reference will now be made in detail to embodiments, examples of which are illustrated in the accompanying drawings. However, the present invention may be embodied in many different forms and should not be construed as limited to the embodiments set forth herein. Rather, these embodiments are provided so that this disclosure will be thorough and complete, and will fully convey the scope of the invention to those skilled in the art. Wherever possible, the same reference numbers will be used throughout the drawings to refer to the same or like parts.

Figure 1:
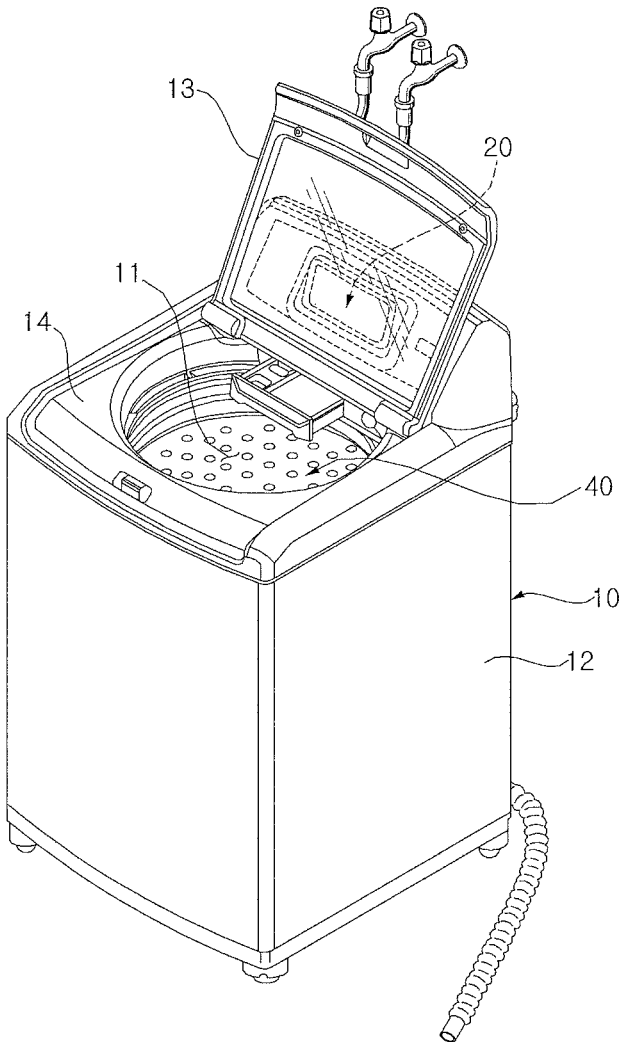
FIG. 1 is a perspective view illustrating a top-loading type washing machine according to a first embodiment of the present invention.
Figure 2:
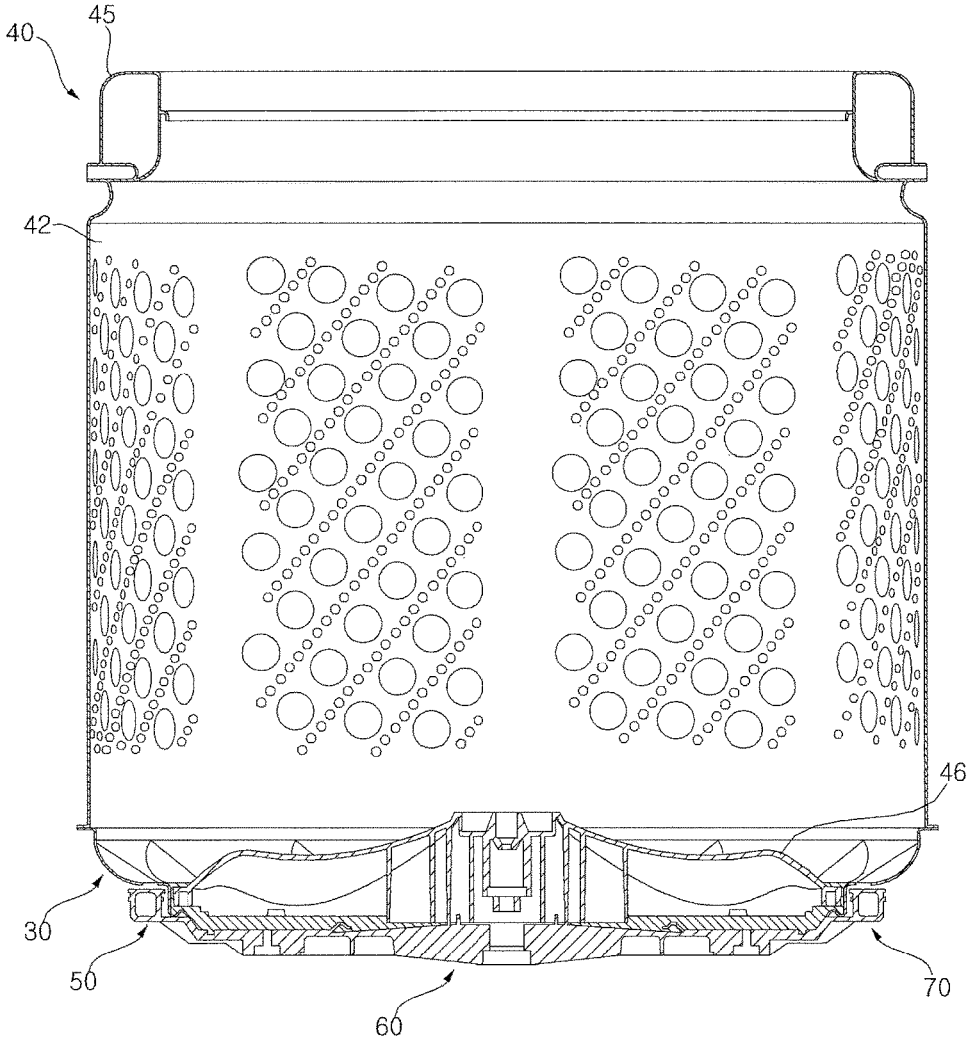
FIG. 2 is a cross-sectional view illustrating a coupling structure of a drum of FIG. 1.
Figure 3:
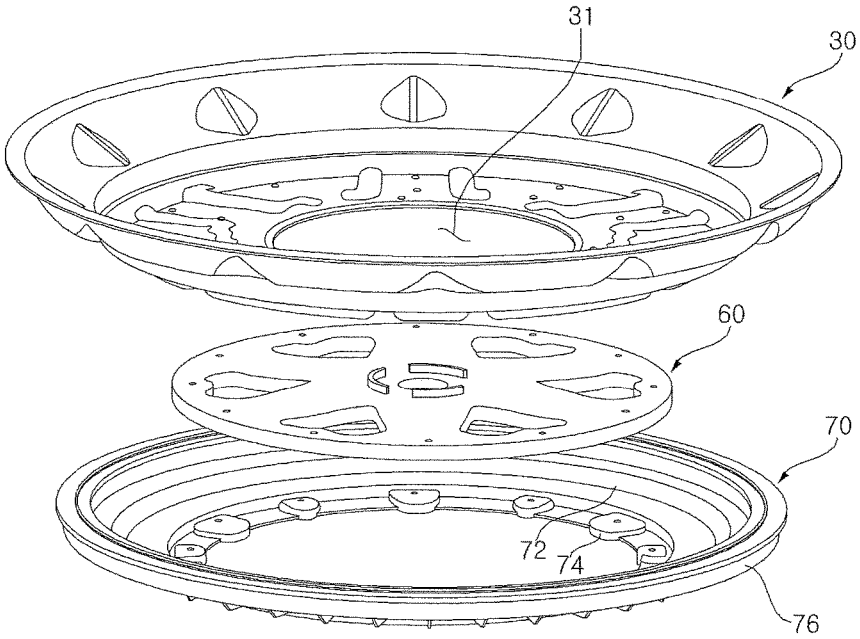
FIG. 3 is an exploded perspective view of a drum assembly illustrated in FIG. 2.
Figure 4:
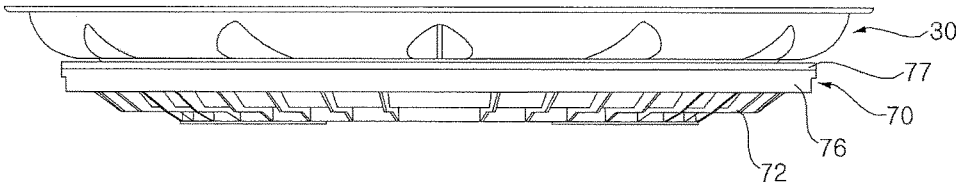
FIG. 4 is a front view illustrating the coupled state of the drum assembly of FIG. 3.
Figure 5:
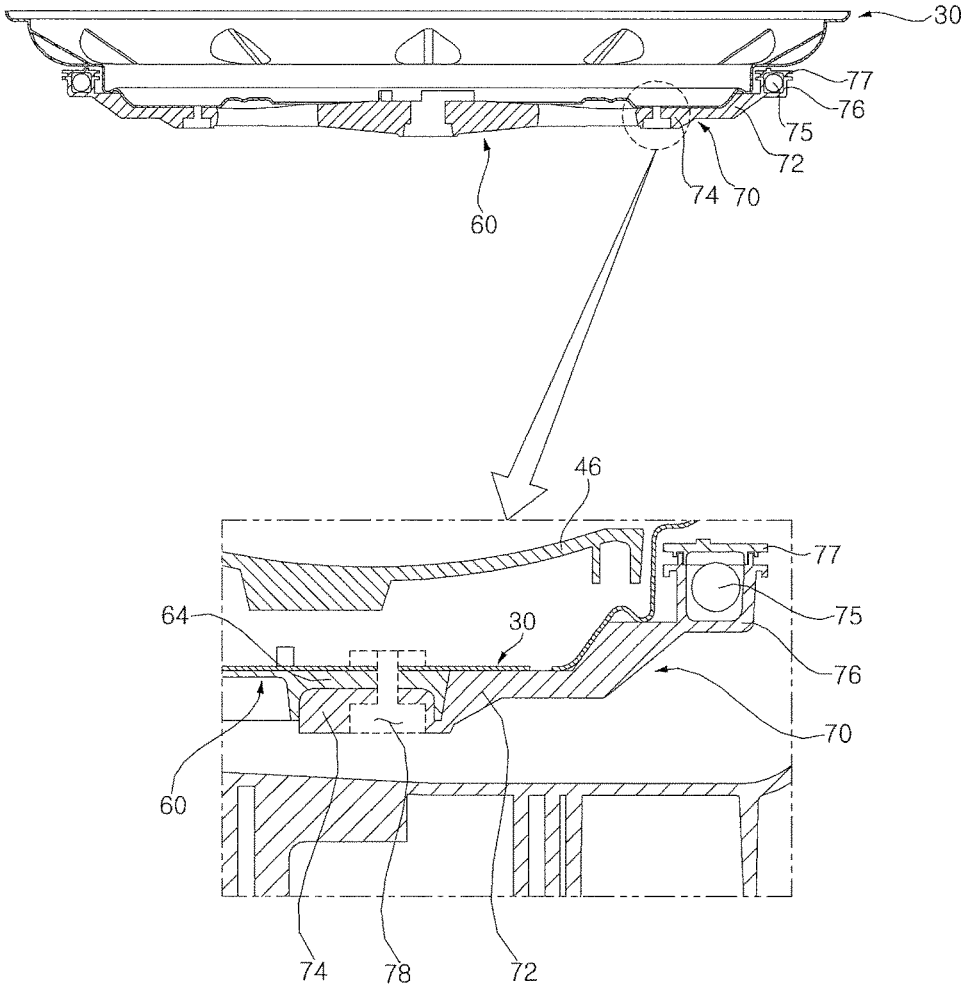
FIG. 5 is a front cross-sectional view of FIG. 4.

FIG. 1 is a perspective view illustrating a top-loading type washing machine according to a first embodiment of the present invention. FIG. 2 is a cross-sectional view illustrating a coupling structure of a drum of FIG. 1. FIG. 3 is an exploded perspective view of a drum assembly illustrated in FIG. 2. FIG. 4 is a front view illustrating the coupled state of the drum assembly of FIG. 3. FIG. 5 is a front cross-sectional view of FIG. 4.

Referring to the drawings, the washing machine according to the present embodiment includes a cabinet 10 which defines the external appearance thereof, a tub (not shown) which is arranged in the cabinet 10 to store wash water, a drum 40 which is arranged in the tub so as to accommodate and wash laundry, and a drive module (not shown) which is mounted to the tub to rotate the drum 40.

The cabinet 10 includes a top cover 14 which has an insertion port 11 formed in the upper side thereof such that laundry may be vertically inserted, a cabinet body 12 which is coupled to the top cover 14 while the tub, the drum 40, and the drive module are installed in the cabinet body 12, and a door 13 which is installed to the top cover 14 to open and close the insertion port 11.

The door 13 has a transparent window. A user may observe the inside of the drum 40 through the transparent window.

The top cover 14 is equipped with a control module 20. The user may select a washing mode using the control module 20. The control module 20 informs the user of the state of operation of the washing machine.

In the embodiment, the drive module is a BLDC motor and is fixed to the lower side surface of the tub. A rotary shaft of the motor is coupled to the drum 40 through the lower side of the tub. The motor is connected to a pulsator 46, which is disposed at the lower portion within the drum 40, and rotates the pulsator 46.

The drive module may selectively drive at least one of the drum 40 and the pulsator 46. Since the method of operating the drum 40 and the pulsator 46 by the drive module is a typical technique known to those skilled in the art, a detailed description thereof will be omitted.

Wash water is stored in the tub. The tub is installed so as to be suspended by the top cover 14 through a suspension module. The suspension module, which is not shown, absorbs vibrations or shocks transferred from the tub.

The drum 40 is arranged in the tub. The drum 40 is rotated in a forward or reverse direction by the drive module.

The drum 40 may be integrally manufactured. In the embodiment, the drum 40 is formed by manufacturing a drum body 42 and a drum base 30 and then assembling them.

In the embodiment, an upper balancer 45 is disposed at the upper side of the drum 40, and a lower balancer 70 is disposed at the lower side of the drum 40. The upper and lower balancers 45 and 70 reduce the vibration of the drum 40.

The upper balancer 45 is fixed to the upper side of the drum body 42, and the lower balancer 70 is fixed to the drum base 30.

A hub 60 is fixed to the drum base 30. In the embodiment, the lower balancer 70 is fixed to the hub 60.

In the embodiment, the drum 40, the hub 60, and the lower balancer 70 are defined as a drum assembly 50.

The drum base 30 forms the bottom surface of the drum 40. The drum base 30 has a ring shape. The drum base 30 has an installation hole 31 formed therein. The hub 60 is installed via the installation hole 31. A drive shaft (not shown) of the drive module is installed through the installation hole 31.

The hub 60 is disposed between the drum base 30 and the drive module. The hub 60 is fixed to the bottom surface of the drum base 30. The hub 60 is installed such that the drive shaft of the drive module passes through the hub 60. The drive shaft is selectively connected to the hub 60, and rotational force is transferred when the hub 60 is connected to the drive shaft.

In the embodiment, the lower balancer 70 has a ring shape. The lower balancer 70 may be manufactured in various forms. The lower balancer 70 may be integrally manufactured. Alternatively, the lower balancer 70 may be divided into many parts for manufacture.

In the embodiment, the lower balancer 70 is fixed to the hub 60. The lower balancer 70 reduces the vibration of the drum 40.

Alternatively, the lower balancer 70 may be fixed to the drum base 30.

Alternatively, the lower balancer 70 may be fixed to the drum body 42.

The lower balancer 70 according to the embodiment includes a balancer body 72, balancer fixing portions 74 which are formed at the balancer body 72 and are fixed to the hub 60, and a balancer portion 76 which is disposed at the outside edge of the balancer body 72 and has masses 75 therein.

The lower balancer 70 is fixed to the hub 60, and comes into close contact with the drum base 30.

Each of the balancer fixing portions 74 has a concave-convex shape in a vertical direction. The balancer fixing portions 74 are engaged with the hub 60. The balancer fixing portions 74 are horizontally latched to the hub 60.

In the embodiment, each of the balancer fixing portions 74 has a convex shape protruding upward, and the hub 60 has a hub fixing portion 64 which has a concave shape so as to be engaged with the associated balancer fixing portion 74. A fastening member, such as a bolt or a nut, may be installed to each of the balancer fixing portions 74. The fastening member fixes the hub 60 to the lower balancer 70.

A fastening groove 78 for the insertion of the fastening member may be formed in the bottom surface of each of the balancer fixing portions 74.

Particularly, in the embodiment, when the lower balancer 70 is fixed, the drum base 30, the hub 60, and the lower balancer 70 are simultaneously fixed.

That is, the fastening member is inserted through the balancer fixing portion 74 in the state in which the drum base 30, the hub 60, and the lower balancer 70 are stacked, and simultaneously fixes the three components 30, 60, and 70. To this end, each of the drum base 30 and the hub 60 has fastening holes formed at respective positions corresponding to the balancer fixing portions 74.

The balancer portion 76 has a space defined therein. The masses 75 are inserted into the balancer portion 76. In the embodiment, each of the masses 75 has a ball shape.

The balancer portion 76 further includes a balancer cover 77. After the masses 75 are embedded in the balancer portion 76, the balancer cover 77 is bonded to the balancer portion 76.

The masses 75 may move within the balancer portion 76. The masses 75 may minimize the eccentricity of the drum 40 while moving within the balancer portion 76 when the drum 40 rotates.

The lower balancer 70 is fixed to the drum assembly 50 through the hub 60. However, the balancer portion 76 having the masses 75 may be located at a higher position than the hub 60.

In the embodiment, the balancer portion 76 is located at a higher position than the hub 60, and comes into close contact with the drum base 30. The masses 75, which are in close contact with the drum base 30, can more effectively remove the vibration of the drum 40.

Since the lower balancer 70 is disposed at the edge of the hub 60, an increase in thickness during the assembly thereof can be minimized.

In addition, the lower balancer 70 can be easily manufactured through the simplified installation structure of the masses 75.

The drum assembly 50 according to the embodiment can effectively reduce vibrations generated by the drum 40 during the rotation of the drum 40 by means of the upper and lower balancers 45 and 70.

Figure 6:
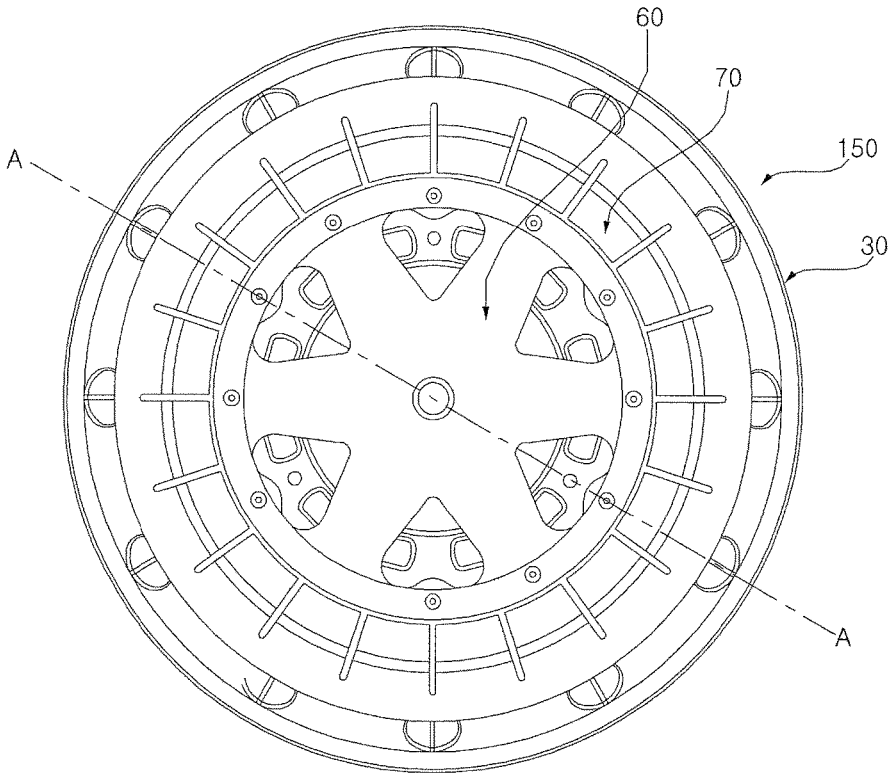
FIG. 6 is a bottom view illustrating a drum assembly according to a second embodiment of the present invention.
Figure 7:
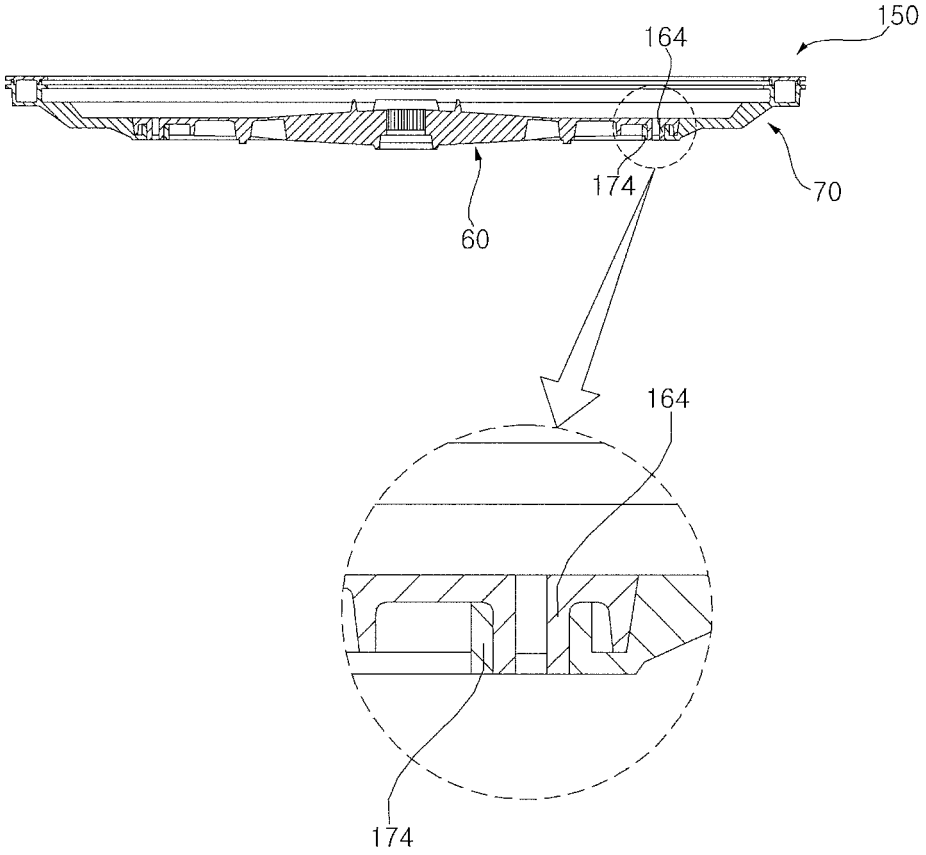
FIG. 7 is a cross-sectional view taken along line "A-A" of FIG. 6.

FIG. 6 is a bottom view illustrating a drum assembly according to a second embodiment of the present invention. FIG. 7 is a cross-sectional view taken along line "A-A" of FIG. 6.

Referring to the drawings, a drum assembly 150 according to the present embodiment differs from that of the first embodiment in that each balancer fixing portion 174 has a concave shape and each hub fixing portion 164 has a convex shape. The balancer fixing portions 174 are horizontally latched to the hub fixing portion 164.

In particular, the balancer fixing portion 174 has a hole which vertically passes therethrough. The hub fixing portion 164 is inserted into the hole of the balancer fixing portion 174 to be coupled to the balancer fixing portion 174.

Since other components are similar to those of the first embodiment, a detailed description thereof will be omitted below.

Figure 8:
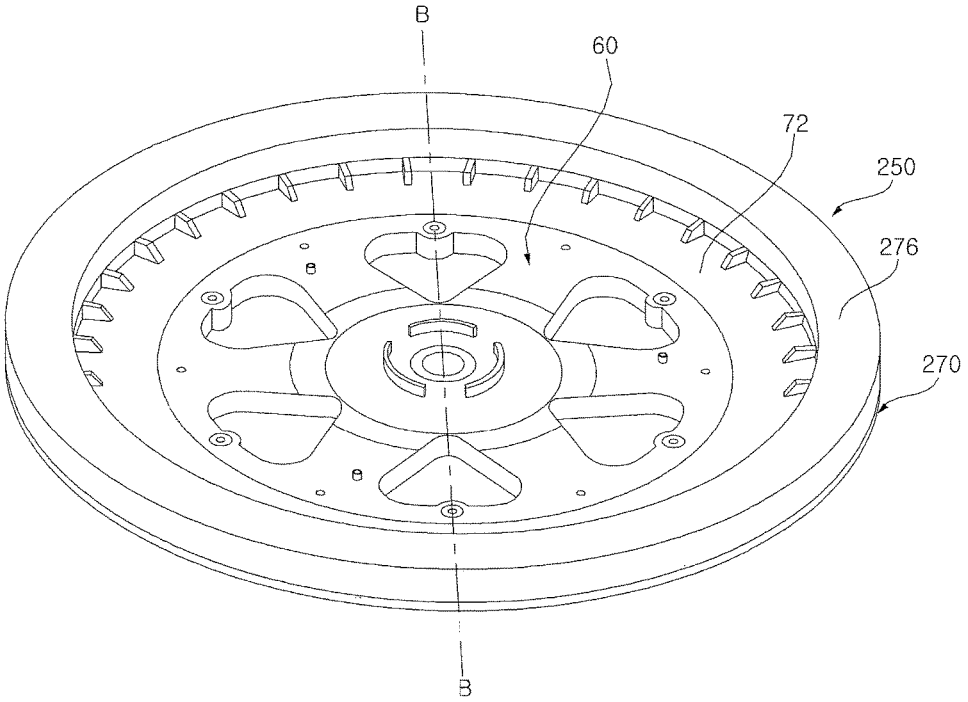
FIG. 8 is a perspective view illustrating a drum assembly according to a third embodiment of the present invention.
Figure 9:
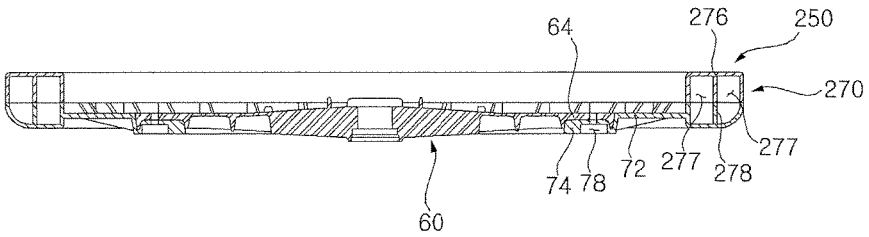
FIG. 9 is a cross-sectional view taken along line "B-B" of FIG. 8.

FIG. 8 is a perspective view illustrating a drum assembly according to a third embodiment of the present invention. FIG. 9 is a cross-sectional view taken along line "B-B" of FIG. 8.

Referring to the drawings, in a drum assembly 250 according to the present embodiment, liquid masses are stored in a balancer portion 276 of a lower balancer 270.

To this end, the balancer portion 276 is manufactured as an enclosed structure that may store liquid, and has a storage space 277 defined therein such that liquid may flow in the storage space 277.

The storage space 277 has a ring shape such that all of the liquid communicates with the storage space 277, and partition walls 278 for radially partitioning the space are arranged in the storage space 277.

Since other components are similar to those of the first embodiment, a detailed description thereof will be omitted below.

Figure 10:
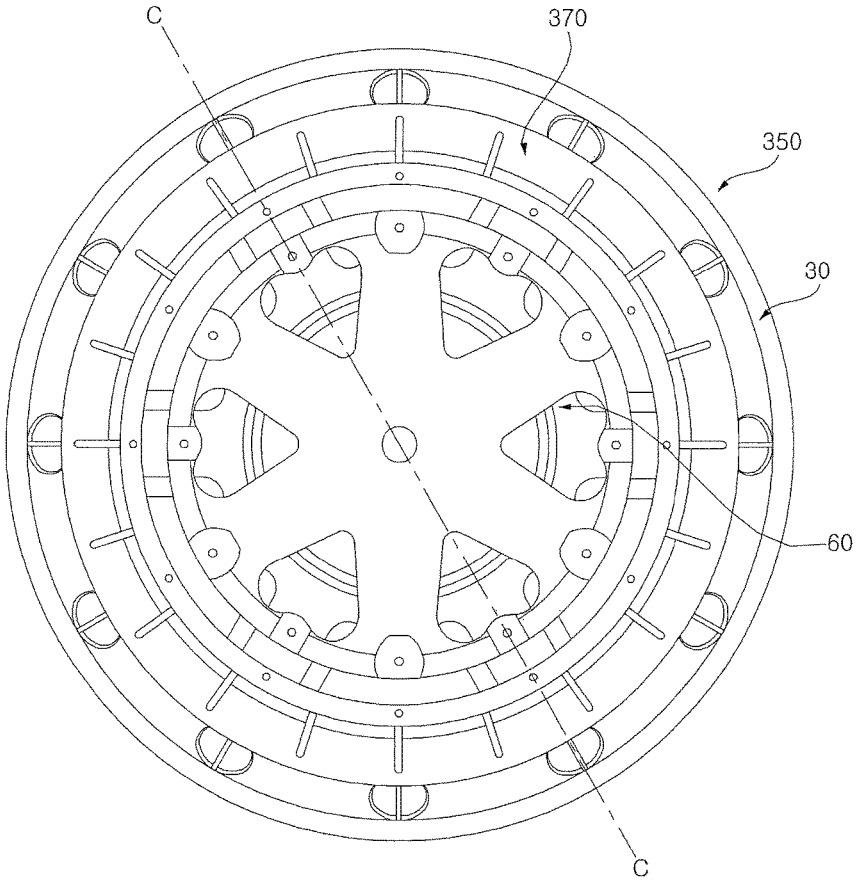
FIG. 10 is a bottom view illustrating a drum assembly according to a fourth embodiment of the present invention.
Figure 11:
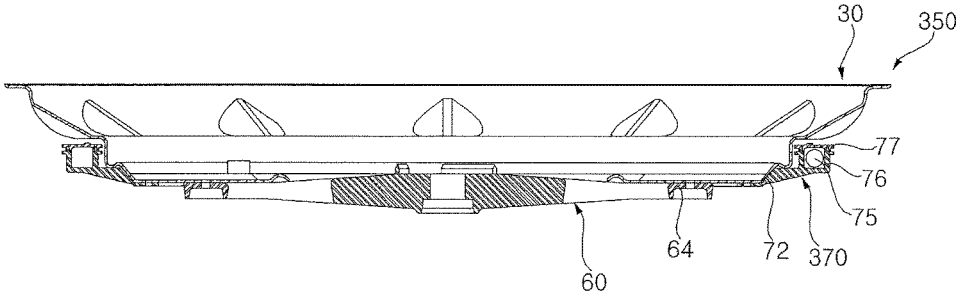
FIG. 11 is a cross-sectional view taken along line "C-C" of FIG. 10.
Figure 12:
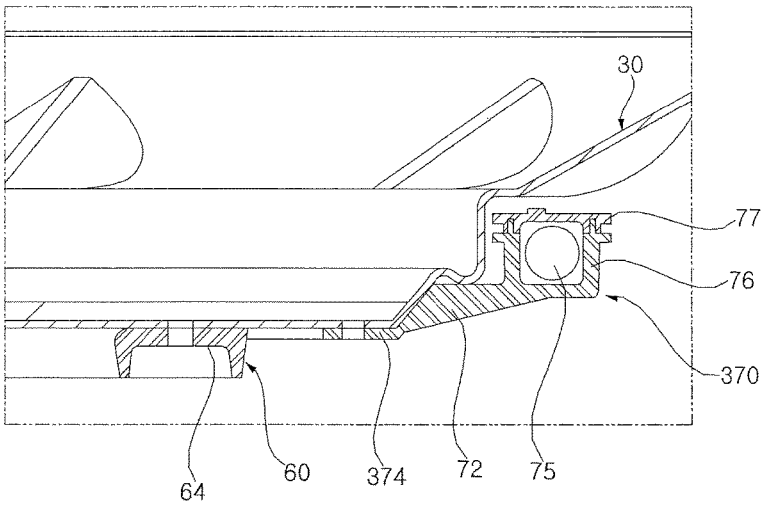
FIG. 12 is an enlarged view of FIG. 11.

FIG. 10 is a bottom view illustrating a drum assembly according to a fourth embodiment of the present invention. FIG. 11 is a cross-sectional view taken along line "C-C" of FIG. 10. FIG. 12 is an enlarged view of FIG. 11.

Referring to the drawings, in a drum assembly 350 according to the present embodiment, a lower balancer 370 is fixed to a drum base 30.

The hub 60 is fixed to the drum base 30 by a fastening member, and the lower balancer 370 is fixed to the drum base 30 by a separate fastening member.

The fastening member for fastening the hub 60 to the drum base 30 is installed to each hub fixing portion 64. The fastening member for fastening the drum base 30 to the lower balancer 370 is installed to each balancer fixing portion 374.

In the embodiment, the balancer fixing portion 374 has a flat shape, and is fixed to the drum base 30.

In the embodiment, the lower balancer 370 is separated from the hub 60. The lower balancer 370 may be installed to the drum base 30, regardless of the assembly of the hub 60.

In addition, since the lower balancer 370 is directly fixed to the drum base 30 in which vibrations are generated, the vibration of the drum 40 can be more effectively reduced.

Since other components are similar to those of the first embodiment, a detailed description thereof will be omitted below.

Figure 13:
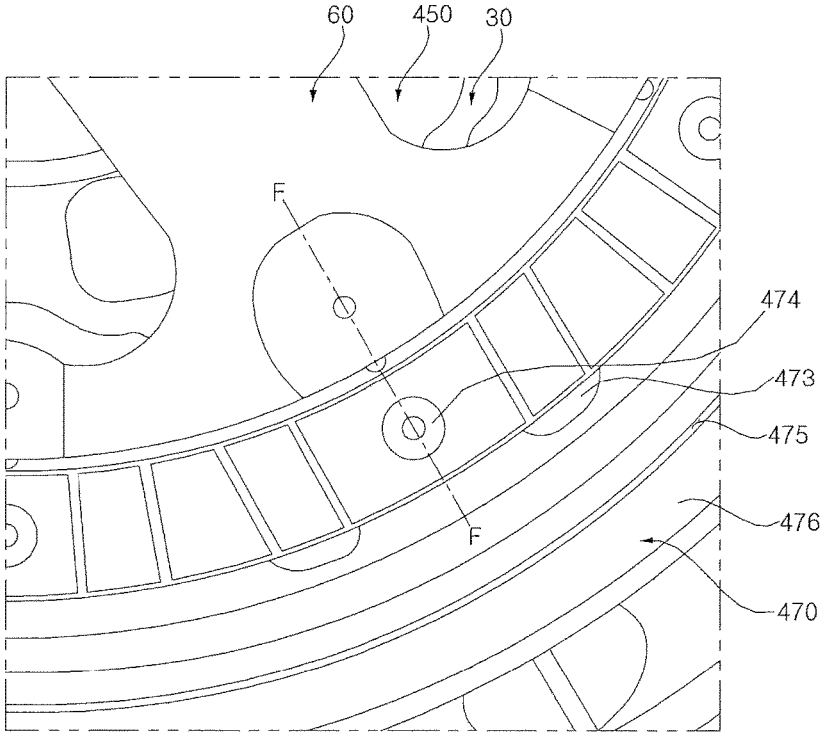
FIG. 13 is a partial bottom view illustrating a drum assembly according to a fifth embodiment of the present invention.
Figure 14:
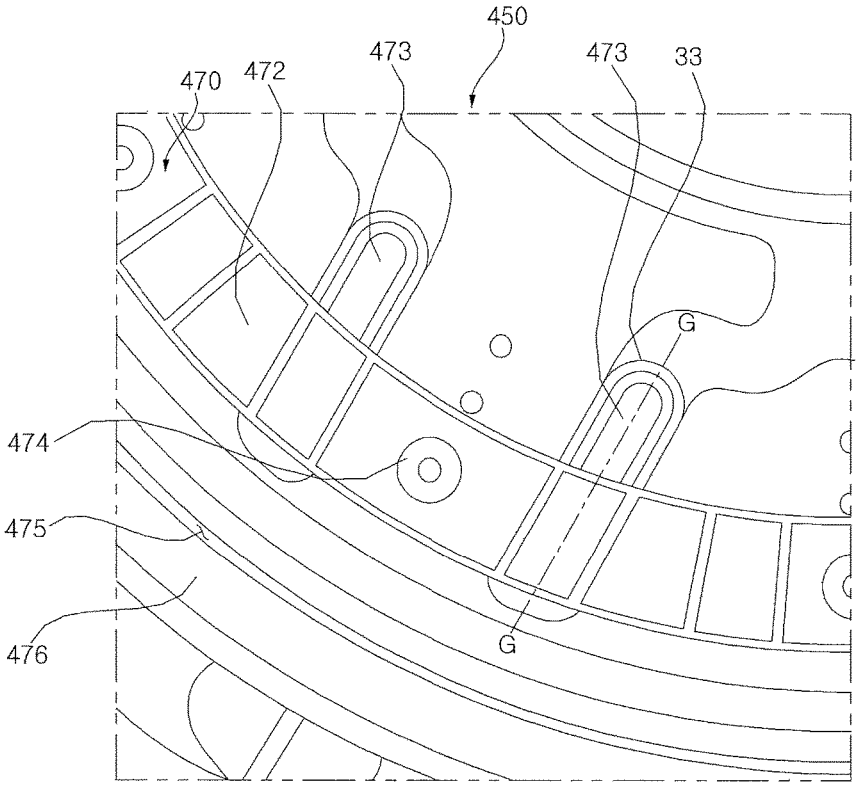
FIG. 14 is a partial bottom view illustrating the drum assembly of FIG. 13, from which a hub is excluded.
Figure 15:
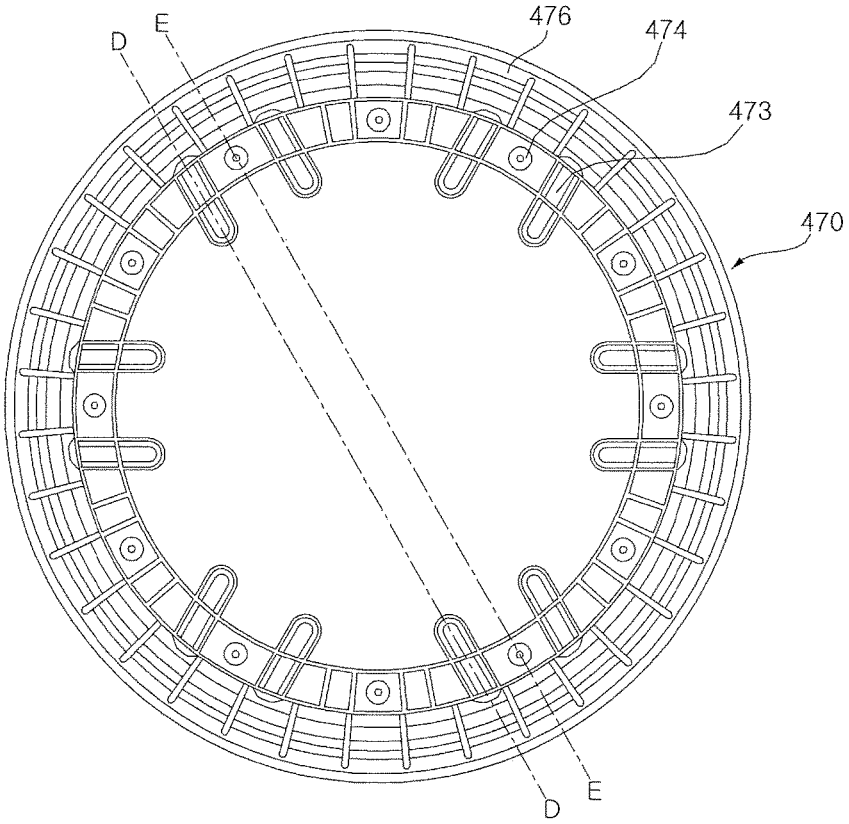
FIG. 15 is a bottom view of a lower balancer illustrated in FIG. 14.
Figure 16:
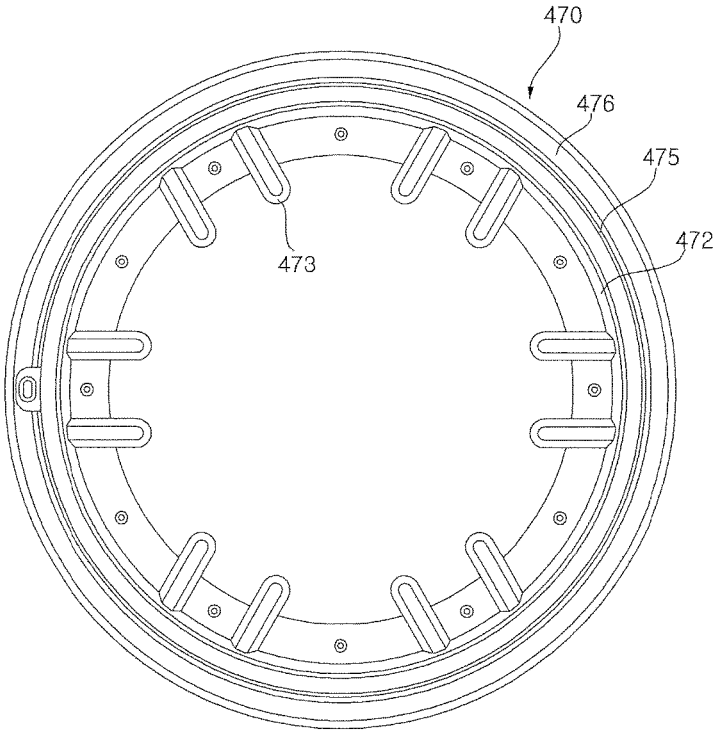
FIG. 16 is a top view of the lower balancer illustrated in FIG. 14.
Figure 17:
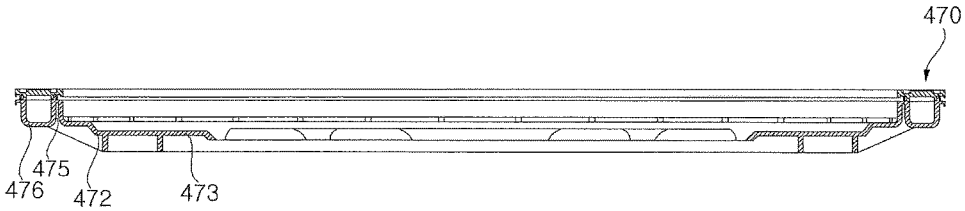
FIG. 17 is a cross-sectional view taken along line "D-D" of FIG. 15.
Figure 18:
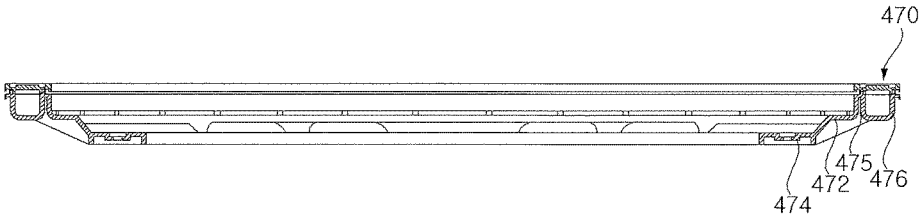
FIG. 18 is a cross-sectional view taken along line "E-E" of FIG. 15.
Figure 19:
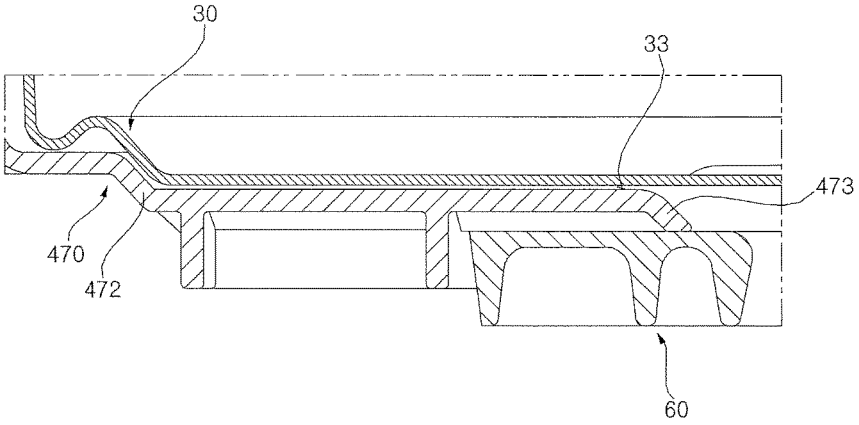
FIG. 19 is a cross-sectional view taken along line "G-G" of FIG. 14.
Figure 20:
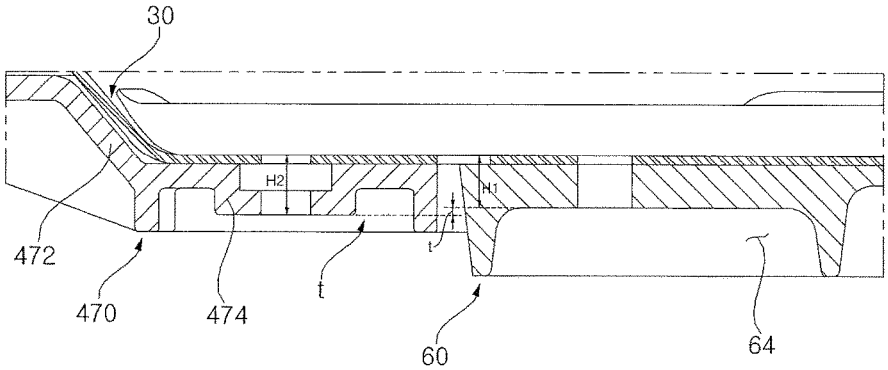
FIG. 20 is a cross-sectional view taken along line "F-F" of FIG. 13.
Figure 21:
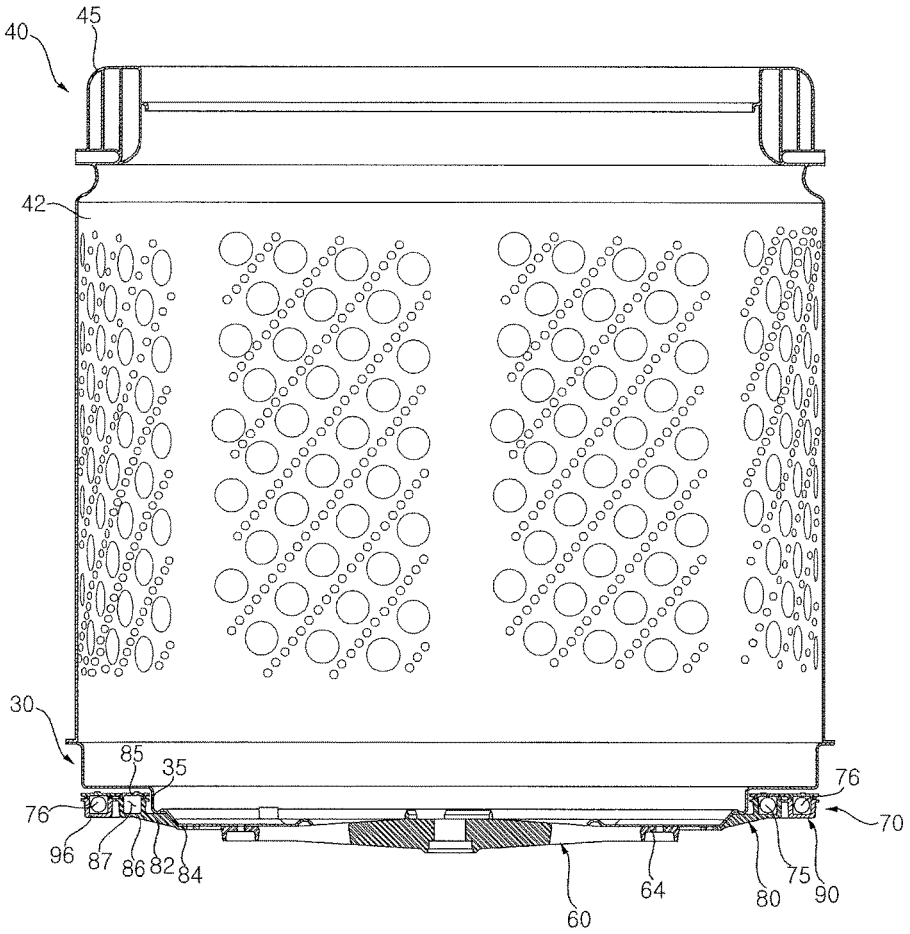
FIG. 21 is a cross-sectional view illustrating a coupling structure of a drum according to a sixth embodiment of the present invention.
Figure 22:
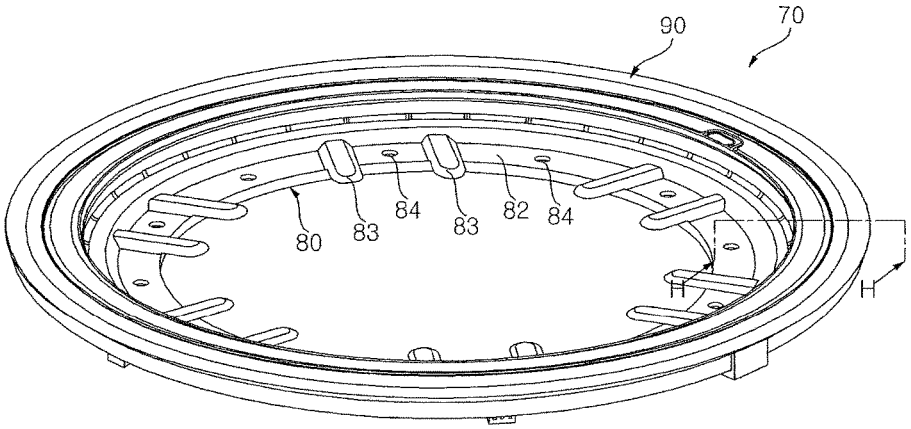
FIG. 22 is a perspective view of a lower balancer illustrated in FIG. 21.
Figure 23:
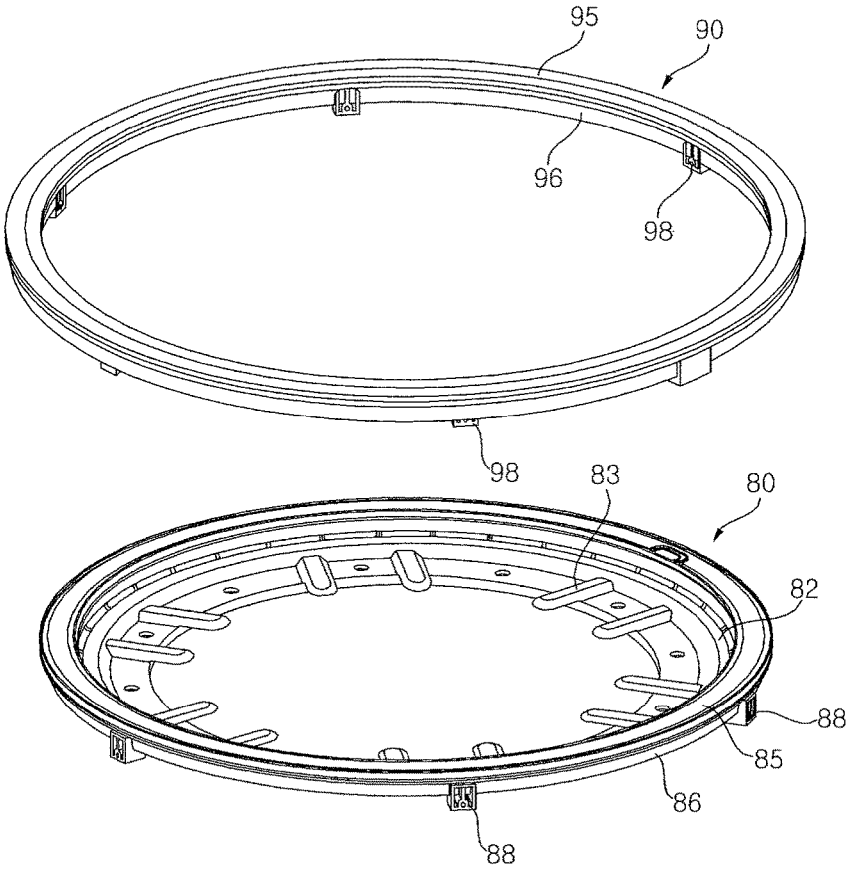
FIG. 23 is an exploded view of FIG. 22.
Figure 24:
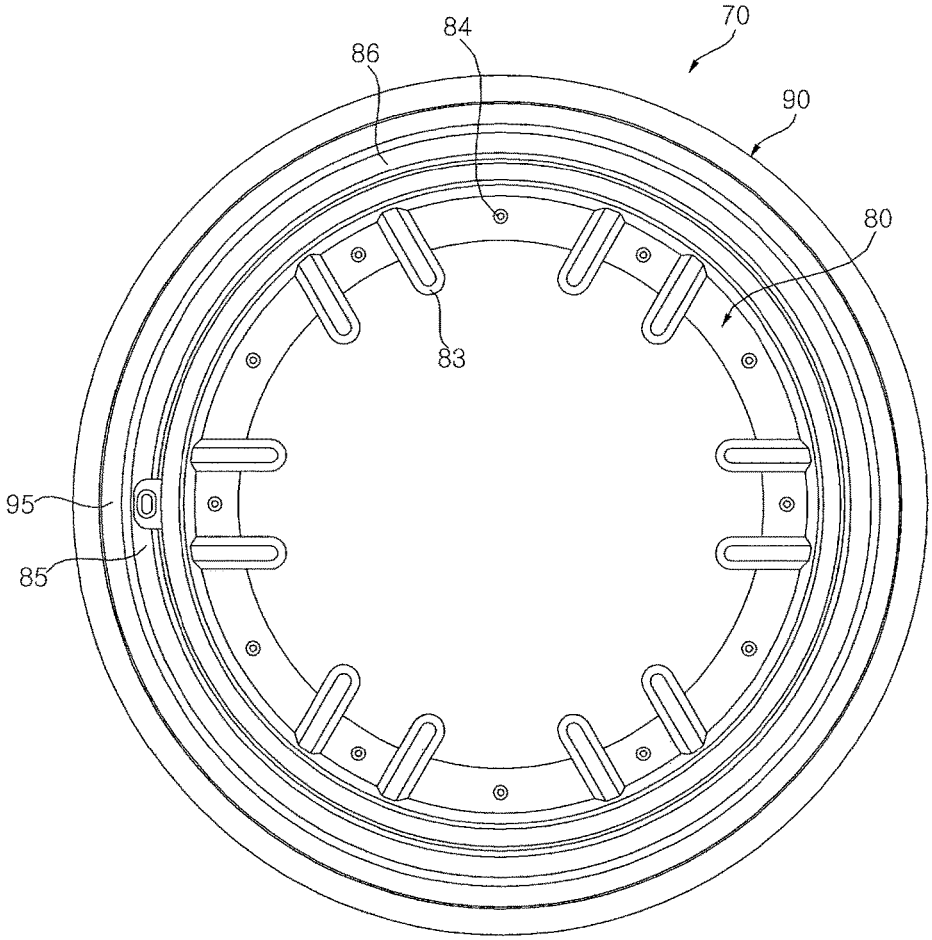
FIG. 24 is a top view of FIG. 22.
Figure 25:
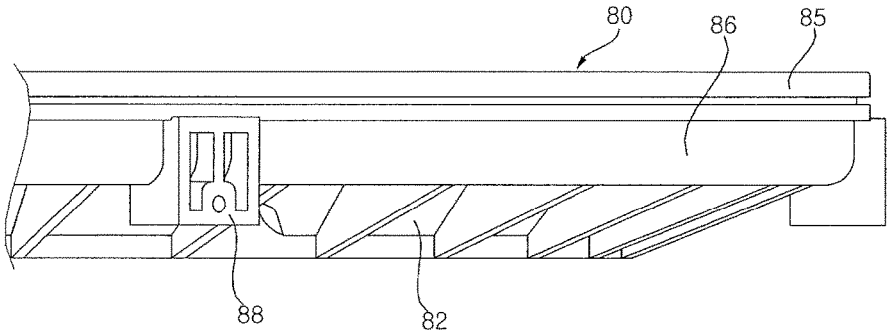
FIG. 25 is a partial enlarged view of a portion illustrated in FIG. 23.
Figure 26:
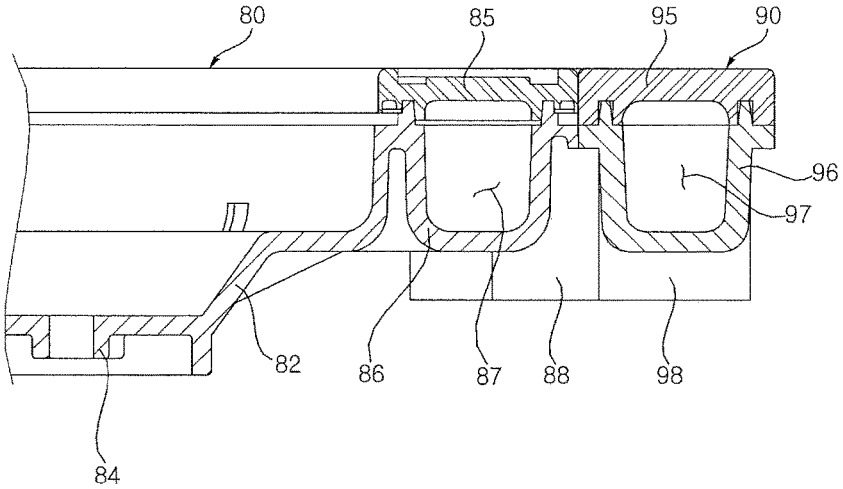
FIG. 26 is a cross-sectional view taken along line "H-H" of FIG. 22.

FIG. 13 is a partial bottom view illustrating a drum assembly according to a fifth embodiment of the present invention. FIG. 14 is a partial bottom view illustrating the drum assembly of FIG. 13, from which a hub is excluded. FIG. 15 is a bottom view of a lower balancer illustrated in FIG. 14. FIG. 16 is a top view of the lower balancer illustrated in FIG. 14. FIG. 17 is a cross-sectional view taken along line "D-D" of FIG. 15. FIG. 18 is a cross-sectional view taken along line "E-E" of FIG. 15. FIG. 19 is a cross-sectional view taken along line "G-G" of FIG. 14. FIG. 20 is a cross-sectional view taken along line "F-F" of FIG. 13.

Referring to the drawings, similarly to the fourth embodiment, in a drum assembly 450 according to the present embodiment, a hub 60 is fixed to a drum base 30, and a lower balancer 470 is fixed to the drum base 30.

However, the drum assembly 450 according to the present embodiment differs from that of the fourth embodiment in that a portion of the lower balancer 470 is disposed between the hub 60 and the drum base 30. A portion of the lower balancer 470 is fitted between the hub 60 and the drum base 30, and the lower end thereof is supported by the hub 60.

The lower balancer 470 includes a balancer body 472 which is fixed to the drum base 30, balancer latch portions 473 which are formed at the balancer body 472 and allow the lower balancer 470 to be horizontally latched to the drum base 30, balancer fixing portions 474 which are formed at the balancer body 472 and are fixed to the drum base 30, and a balancer portion 476 which is disposed at the edge of the balancer body 472 and is connected to the balancer body 472 with a clearance groove 475 interposed therebetween.

The drum base 30 is formed with base latch portions 33. Each of the balancer latch portions 473 is inserted into the associated base latch portion 33. The base latch portion 33 is horizontally latched to the balancer latch portion 473.

The base latch portion 33 and the balancer latch portion 473 have shapes corresponding to each other. The base latch portion 33 and the balancer latch portion 473 may have concave and convex shapes in a vertical direction.

Each of the balancer fixing portions 474 has a hole for the installation of a bolt/nut. The balancer fixing portion 474 has a boss which protrudes downward. The hole is formed in the center of the boss.

The hub 60 has the hub fixing portions 64 having a concave shape, as illustrated in the first embodiment.

In order to use the same standard fastening member for each of the hub fixing portions 64 and the associated balancer fixing portion 474, the hub fixing portion 64 and the balancer fixing portion 474 are flush with each other after they are fastened.

After each fastening member is installed, a fastening height H1 between the hub fixing portion 64 and the drum base 30 is preferably equal to a fastening height H2 between the balancer fixing portion 474 and the drum base 30.

FIG. 20 illustrates that the fastening height H1 differs from the fastening height H2. However, the different fastening heights H1 and H2 in the drawing are designed in consideration of the materials of the balancer body 472 and the hub 60. After the fastening members are respectively fastened thereto, the fastening height H1 of the hub fixing portion 64 is the same as the fastening height H2 of the balancer fixing portion 474.

The hub 60 is made of a harder material because it transfers the rotational force of the drive module. Since the balancer body 472 does not transfer any rotational force, it may be made of a softer material.

In the embodiment, although the balancer fixing portion 474 is about 1 mm thicker than the hub fixing portion 64, the fastening heights H1 and H2 are equal to each other after they are fastened.

The spaces defined inside the balancer fixing portion 474 and the drum base 30 are reducing spaces for saving material. The reducing spaces also perform a function of allowing the fastening heights H1 and H2 to be equal to each other while being deformed when the balancer fixing portion 474 is fastened to the drum base 30.

The balancer groove 475 is formed between the balancer body 472 and the balancer portion 476. The balancer groove 475 is vertically formed. The balancer portion 476 may be elastically deformed independently of the balancer body 472.

Since the balancer portion in the first to fourth embodiments is formed integrally with the balancer body, only the masses arranged within the balancer portion generate relative movement.

In contrast, when vibrations or shocks are applied to the balancer portion 475 in the present embodiment, the balancer body 472 may be separately bent or twisted. This bending or twisting is generated due to the elastic deformation of material.

Vibrations or shocks may be absorbed or reduced by the elastic deformation of the balancer portion 475. In addition, when vibrations or shocks are transferred in the state in which the masses are embedded in the balancer portion 475, the balancer portion 475 may reduce the vibrations or shocks while being vertically bent and deformed.

Meanwhile, the base latch portion 33 is horizontally latched to the drum base 30. The base latch portion 473 is supported by the hub 60 in the state in which the base latch portion 33 is horizontally latched to the drum base 30.

As illustrated in FIG. 19, after the hub 60 is fixed to the drum base 30, the inside end of the base latch portion 473 comes into close contact with the upper side surface of the hub 60. The inside end of the base latch portion 473 is maintained in the state in which the base latch portion 473 is supported by the hub 60.

The hub 60 is horizontally spaced apart from the lower balancer 470. However, a portion (base latch portion 473) of the lower balancer 470 is fitted between the drum base 30 and the hub 60 in order to maintain the state in which the drum base 30, the hub 60, and the lower balancer 470 are stacked.

Since the base latch portion 473 is fitted and supported between the hub 60 and the drum base 30, it may absorb or reduce vibrations using the elasticity of the material thereof.

That is, the lower balancer 470 according to the embodiment can use the masses to reduce eccentricity caused by the imbalance of laundry. In addition, the lower balancer 470 can reduce vibrations between the hub 60 and the drum base 30.

Meanwhile, the balancer latch portion 473 illustrated in the present embodiment may be included in the first to third embodiments.

Since other components are similar to those of the first or fourth embodiment, a detailed description thereof will be omitted below.

A sixth embodiment of the present invention will be described with reference to FIGS. 21 to 26.

The coupling structure of a drum according to the present embodiment is similar to that of the fourth embodiment.

A lower balancer 70 according to the present embodiment differs from that of the fourth embodiment in that first and second masses 75 and 75' are arranged within different radiuses of the lower balancer 70.

The lower balancer 70 includes a first balancer 80 which is fixed to a drum base 30, and a second balancer 90 which is fixed to the first balancer 80.

Hereinafter, it is noted that the same function is performed when the first and second balancers 80 and 90 are referred to using as the same name, whereas the terms "first" and "second" are used to refer to the balancers when there is a need to distinguish the installation positions of the balancers.

The first balancer 80 includes a balancer body 82 which is fixed to the drum base 30, balancer latch portions 83 which are formed at the balancer body 82, are inserted into the bottom surface of the drum base 30, and allow the first balancer 80 to be horizontally latched to the drum base 30, balancer fixing portions 84 which are formed at the balancer body 82 and are fixed to the drum base 30, a balancer portion 86 which has a ring shape, is formed at the balancer body 82, and realizes balancing while the first masses 75 move in the balancer portion 86, and balancer connection portions 88 which are formed at the balancer portion 86 and are coupled to the second balancer 90.

The balancer body 82 has a plate shape. The balancer body 82 comes into close contact with the bottom surface of the drum base 30. The balancer body 82 has a shape corresponding to the bottom surface of the drum base 30.

The balancer latch portions 83 vertically protrude. A plurality of balancer latch portions 83 is radially formed about the shaft of a drive module.

The balancer latch portions 83 are respectively inserted into the base latch portions 33 (see FIG. 14) which are formed at the bottom surface of the drum base 30. The balancer latch portions 83 suppress the balancer body 82 from circumferentially rotating.

In particular, since each of the balancer latch portions 83 is engaged with the associated base latch portion 33, the assembler can simply position the first balancer 80 at the drum base 30.

The balancer latch portion 83 is located between the hub 60 and the drum base 30. As illustrated in the fourth embodiment, when the hub 60 is assembled to the drum base 30, the balancer latch portion 83 may be fitted and fixed between the drum base 30 and the hub 60.

In the embodiment, each of the balancer fixing portions 84 is a hole which is vertically formed. The balancer fixing portion 84 is fixed to the drum base 30 in such a manner that a fastening member (not shown) passes through the balancer fixing portion 84.

The balancer portion 86 has a ring shape. The balancer portion 86 has a balancer groove 87 formed therein such that at least one first mass 75 moves in the balancer groove 87.

In the embodiment, the first mass 75 has the form of a metallic ball. Alternatively, the first mass 75 may be a liquid.

In the embodiment, the balancer portion 86 is open at the upper side thereof. A balancer cover 85 is provided to close the balancer groove 87. The balancer cover 85 is bonded and fixed to the balancer portion 86.

The balancer connection portions 88 are portions for coupling with the second balancer 90. A plurality of balancer connection portions 88 is radially arranged about the shaft of the drive module. In the embodiment, six balancer connection portions 88 are arranged at regular intervals.

In the embodiment, each of the balancer connection portions 88 is coupled to the second balancer 90 by a fastening member (not shown). Alternatively, the first balancer 80 may be coupled to the second balancer 90 by latching such as hooking. Alternatively, the first balancer 80 may be coupled to the second balancer 90 by fitting.

The second balancer 90 is disposed radially with respect to the first balancer 80. In the embodiment, the second balancer 90 is disposed radially outwardly from the first balancer 80. Alternatively, the second balancer 90 may be located radially inwardly. The second balancer 90 performs balancing, independently of the first balancer 80.

The second balancer 90 may be detached from the first balancer 80. When the washing machine is assembled, the second balancer 90 may be detached or attached according to the capacity of the drum 40.

For example, when the washing capacity is increased, the second balancer 90 may be attached without manufacturing a separate lower balancer. Since the washing capacity is increased by the second balancer 90, balancing can be effectively performed.

In addition, the second masses 75', which are installed to the second balancer 90, may be changed according to the type of laundry or an increase in capacity. Balancing ability can be actively enhanced by changing the types, masses, and shape of the second masses 75'.

The second balancer 90 includes a balancer portion 96 which has a balancer groove 97 formed therein, a balancer cover 95 which shields the balancer portion 96, and balancer connection portions 98 which are coupled to the first balancer 80.

The balancer portion 96 and the balancer cover 95 may be integrally manufactured according to the types of the second masses 75'.

The first balancer connection portions 88 are disposed to the outside of the first balancer portion 86, and the second balancer connection portions 98 are disposed to the inside of the second balancer portion 96.

When the second balancer 90 is assembled, the first and second balancer connection portions 88 and 98 are arranged in a row, and are then fastened to each other by horizontally inserting a fastening member (not shown) thereinto.

Meanwhile, the drum base 30 is formed with a balancer installation portion 35. The lower balancer 70 is located at the balancer installation portion 35.

The balancer installation portion 35 is located at a higher position then the hub 60. The balancer installation portion 35 serves to install the lower balancer 70 at a higher position.

When the lower balancer 70 is installed high in the drum base 30, the eccentricity of the drum 40 can be effectively reduced. In the embodiment, the balancer installation portion 35 is formed by bending the drum base 30. The balancer installation portion 35 is a stepped portion which is formed at the bottom surface of the drum base 30.

The balancer installation portion 35 is preferably located at the outside of the drum base 30. The lower balancer 70 installed at the balancer installation portion 35 may be located at the same height as laundry in the drum 40. When the lower balancer 70 is flush with laundry, balancing can be effectively performed.

Since other components are similar to those of the first or fourth embodiment, a detailed description thereof will be omitted below.

Figure 27:
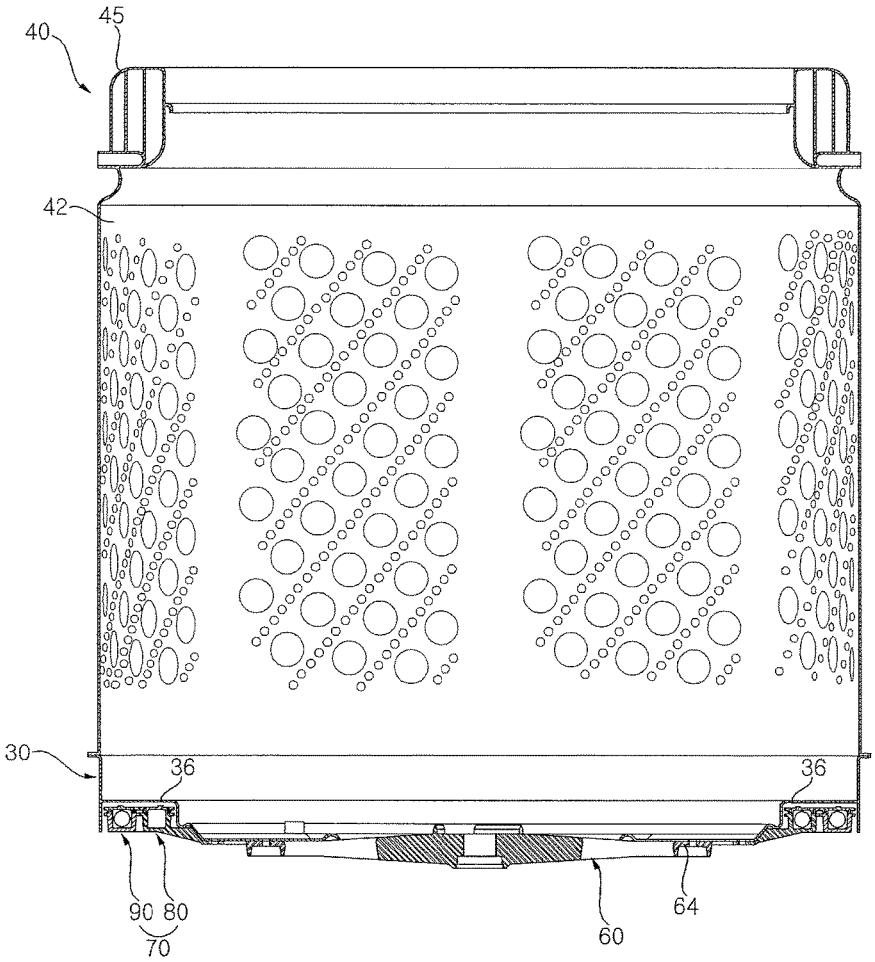
FIG. 27 is a cross-sectional view illustrating a coupling structure of a drum according to a seventh embodiment of the present invention.

A seventh embodiment of the present invention will be described with reference to FIG. 27.

A drum base 30 according to the present embodiment is formed such that a balancer installation portion 36 protrudes inward from a drum 40.

The balancer installation portion 36 protrudes upward. The balancer installation portion 36 has a convex shape in an upward direction. The balancer installation portion 36 has the form of a ring which is circumferentially formed around the axis thereof.

A lower balancer 70 is inserted into the balancer installation portion 36 to be fixed thereto.

In the embodiment, the lower balancer 70 is located radially outwardly from a hub 60. Alternatively, the lower balancer 70 may be disposed between the hub 60 and the drum base 30.

That is, the hub 60, the lower balancer 70, and the drum base 30 may be stacked and installed in this order. In this case, the balancer installation portion is located above the hub 60.

Since other components are similar to those of the sixth embodiment, a detailed description thereof will be omitted below.

Figure 28:
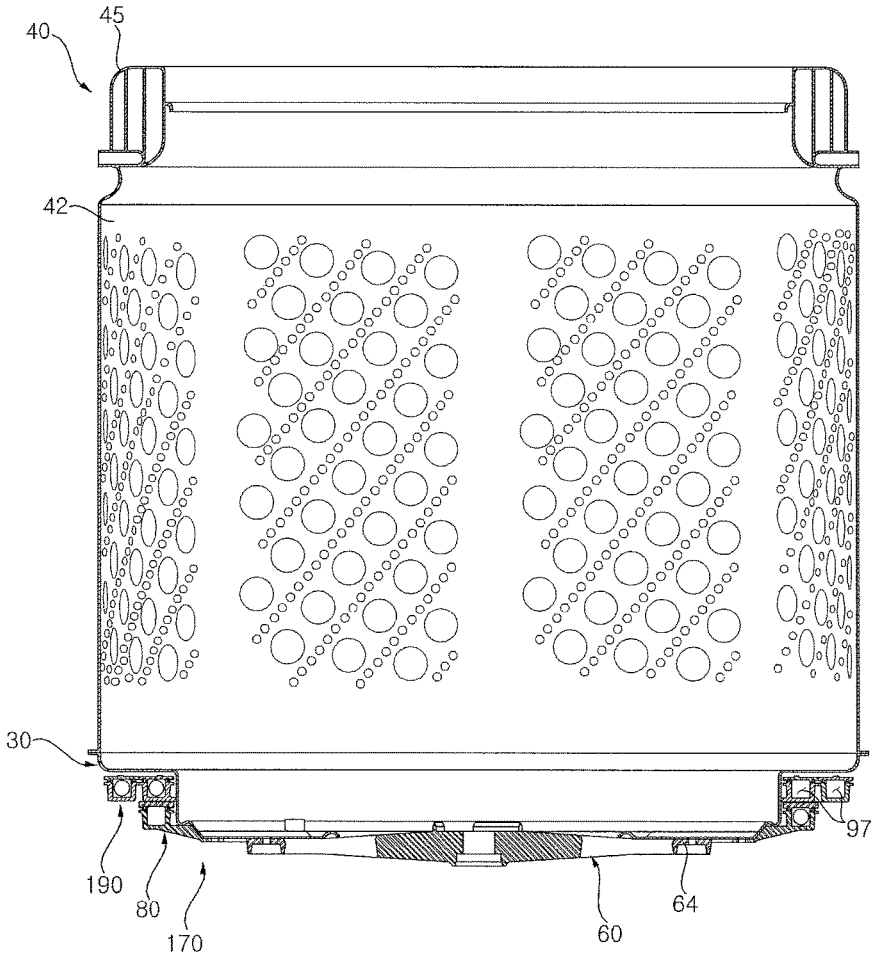
FIG. 28 is a cross-sectional view illustrating a coupling structure of a drum according to an eighth embodiment of the present invention.

An eighth embodiment of the present invention will be described with reference to FIG. 28.

A lower balancer 170 according to the present embodiment is installed such that a second balancer 190 is disposed above a first balancer 80.

A balancer connection portion is disposed between the first and second balancers 80 and 190. A fastening member is vertically installed.

The second balancer 190 has a plurality of balancer grooves 97 which is horizontally formed. A second mass 75' is disposed in each of the balancer grooves 97.

In the embodiment, the second balancer 190 is disposed at a higher position than the first balancer 80. When the first and second balancers 80 and 190 are vertically stacked and installed, balancing ability can be enhanced.

The second balancer 190 may also be attached and detached according to a washing capacity, as in the sixth embodiment.

Since other components are similar to those of the sixth embodiment, a detailed description thereof will be omitted below.

Figure 29:
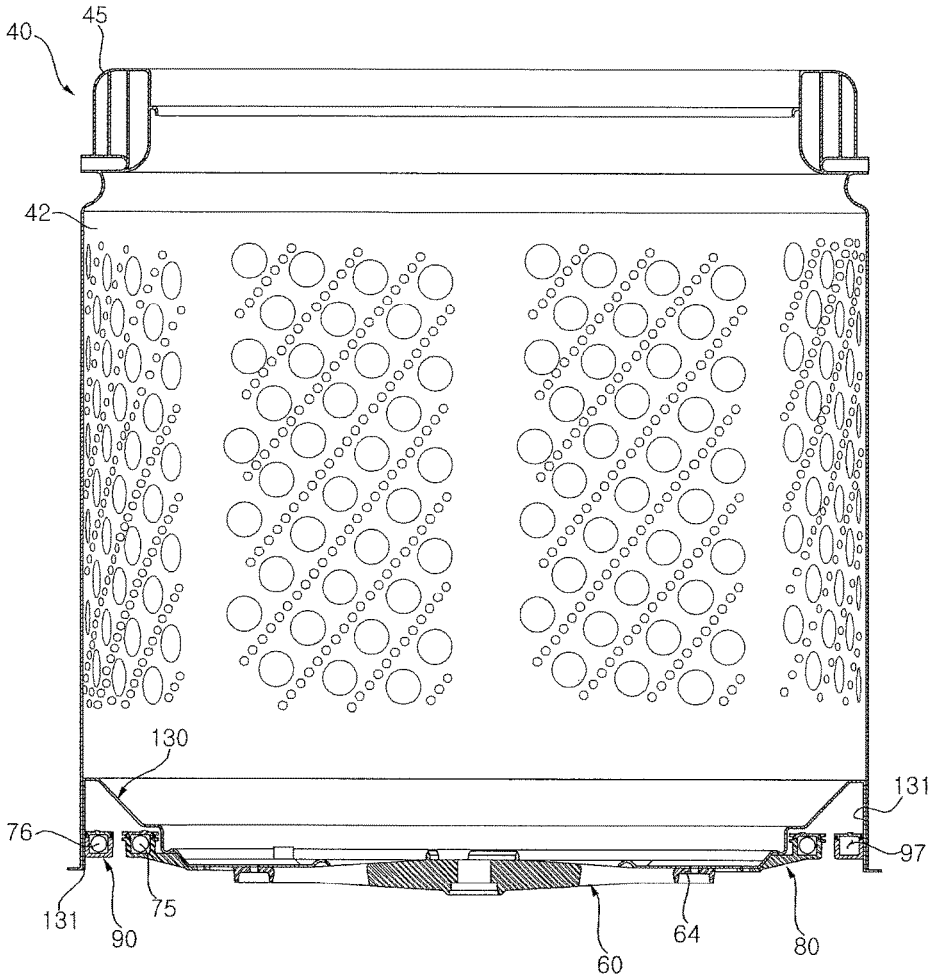
FIG. 29 is a cross-sectional view illustrating a coupling structure of a drum according to a ninth embodiment of the present invention.

A ninth embodiment of the present invention will be described with reference to FIG. 29.

A lower balancer according to the present embodiment is installed such that a first balancer 80 is separated from a second balancer 90.

Both of the first and second balancers 80 and 90 are installed to a drum base 130.

The drum base 130 includes a drum base inner wall 131 which extends downward along the outside surface of a drum body 42.

The second balancer 90 is fastened to the drum base inner wall 131.

The second balancer 90 is disposed at the same horizontal position as the first balancer 80. Alternatively, the first and second balancers 80 and 90 may be disposed so as to have a difference in height.

Since other components are similar to those of the sixth embodiment, a detailed description thereof will be omitted below.

Figure 30:
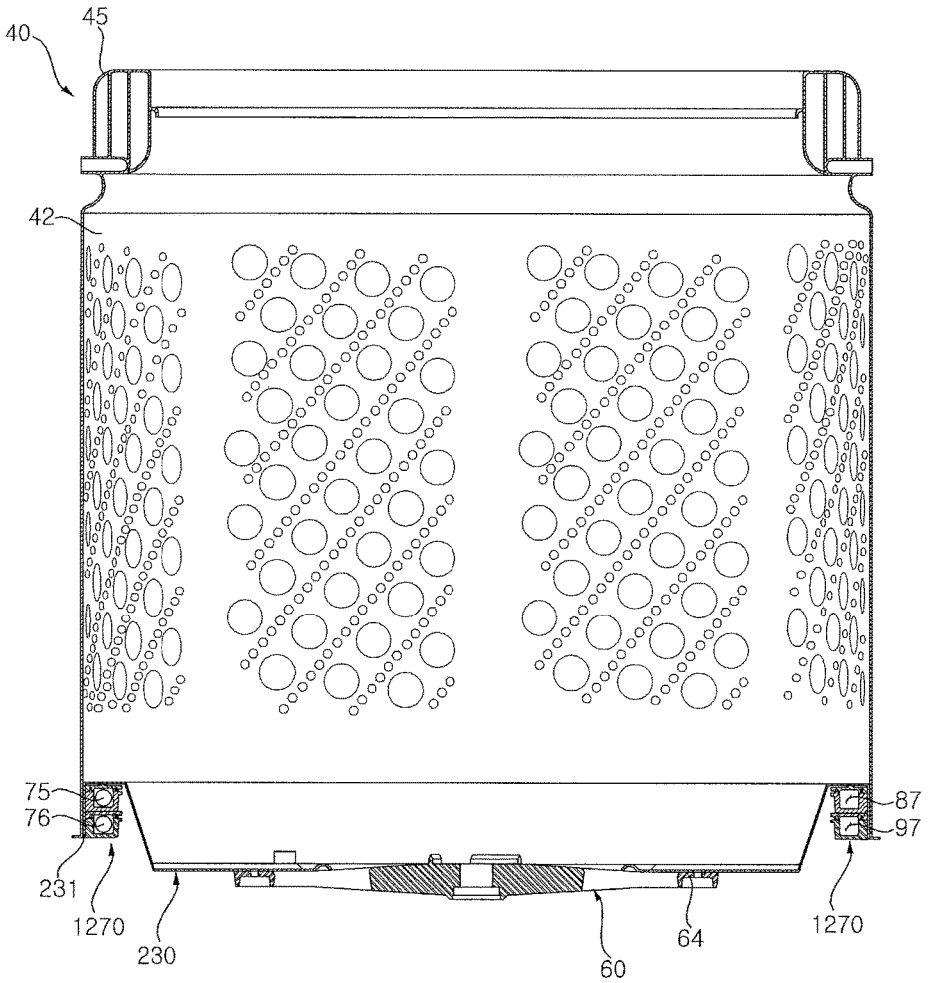
FIG. 30 is a cross-sectional view illustrating a coupling structure of a drum according to a tenth embodiment of the present invention.

A tenth embodiment of the present invention will be described with reference to FIG. 30.

A lower balancer 1270 according to the present embodiment differs from that of the ninth embodiment in that the lower balancer 1270 is fixed to the inside surface of a drum body 42.

In the embodiment, a drum base 230 is formed on a drum base inner wall 231 which extends downward along the outside surface of the drum body 42. The lower balancer 1270 is fixed to the drum base inner wall 231.

In the embodiment, the lower balancer 1270 consists of first and second balancers which are vertically arranged.

Figure 31:
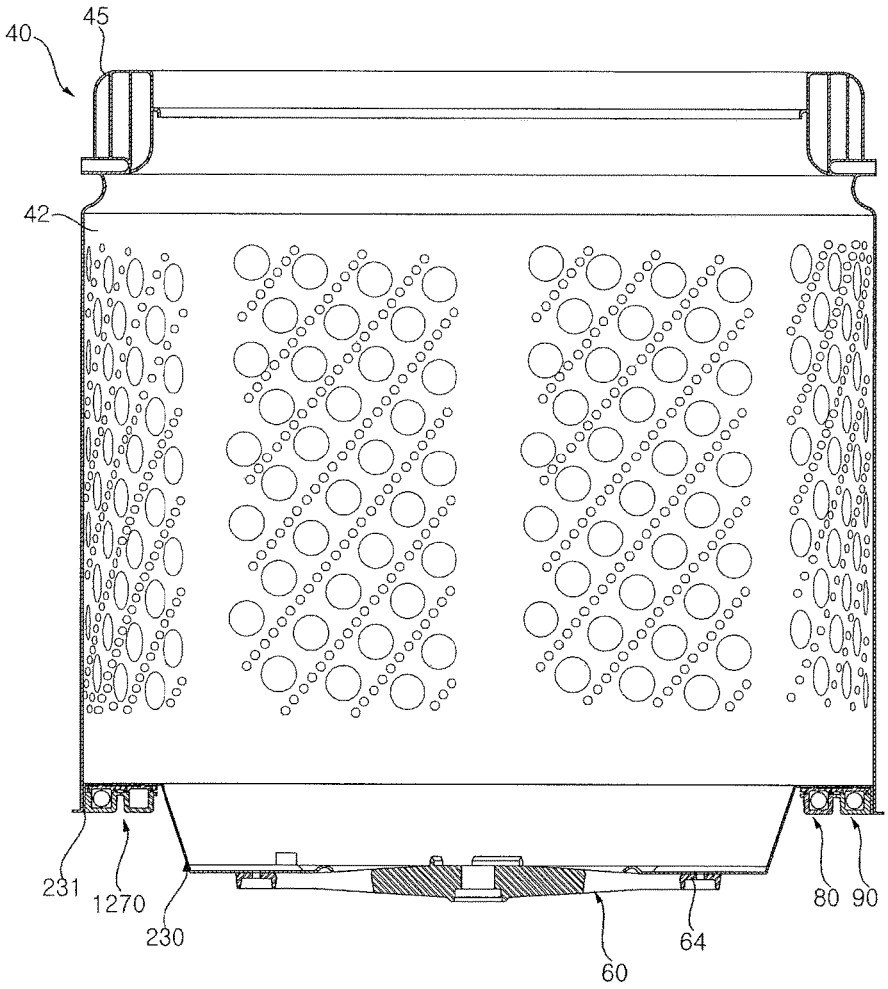
FIG. 31 is a cross-sectional view illustrating a coupling structure of a drum according to an eleventh embodiment of the present invention.

Meanwhile, referring to FIG. 31, first and second balancers 80 and 90 may be horizontally disposed, unlike the case of the tenth embodiment.

Since other components are similar to those of the ninth embodiment, a detailed description thereof will be omitted below.

As is apparent from the above description, the top-loading type washing machine according to the present invention can effectively remove eccentricity or vibrations generated during the rotation of the drum, since the lower balancer is installed at the lower side of the drum.

In addition, the top-loading type washing machine according to the present invention can be easily assembled since the lower balancer, the hub, and the drum are simultaneously fixed by the fastening member.

In the top-loading type washing machine according to the present invention, since the hub and the lower balancer are latched to each other when the lower balancer is assembled, positioning can be easily performed during the assembly thereof.

In addition, the top-loading type washing machine according to the present invention can more effectively relieve the eccentricity of the drum, since the lower balancer is located at a higher position than the hub so as to come into close contact with the lower side of the drum.

In the top-loading type washing machine according to the present invention, since the lower balancer is configured as a plurality of balancers, and at least one of them is detachably mounted to the washing machine, the balancers can be actively attached and detached according to the washing capacity.

In addition, the top-loading type washing machine according to the present invention can effectively reduce vibrations, since at least one of the first and second balancers constituting the lower balancer is located at a higher position than the hub.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A top-loading type washing machine comprising:

a drum comprising a drum body opened at upper and lower sides thereof, and a drum base coupled to the lower side of the drum body;

a hub fixed to the drum base, the hub including a hub fixing portion that is located vertically below the drum base;

an upper balancer installed to the drum body, for reducing vibrations generated when the drum rotates; and a lower balancer fixed to the hub, for reducing vibrations generated when the drum rotates, the lower balancer including a balancer fixing portion that is located vertically below the hub fixing portion, wherein an upper surface of the hub fixing portion is flat and contacts the drum base, wherein the hub fixing portion protrudes downward and defines a concave portion that is recessed upward in a vertical direction, and wherein the balancer fixing portion is located below the hub fixing portion and includes a convex portion that protrudes upward in the vertical direction and that inserts into the concave portion of the hub fixing portion, wherein the balancer fixing portion defines a fastening groove that is recessed upward from a lower side of the convex portion and that is configured to receive a fastening member, wherein each of the hub fixing portion, the balancer fixing portion, and the drum base defines a fastening hole, the fastening holes being configured to align to each other in the vertical direction, wherein the balancer fixing portion, the hub fixing portion, and the drum base are configured to be coupled to each other in order by the fastening member that is inserted into the fastening groove of the balancer fixing portion and that passes through the fastening holes in order.

2. The top-loading type washing machine according to claim 1, wherein the lower balancer comprises:

a balancer body that includes the balancer fixing portion configured to be coupled to the hub;

a balancer portion disposed outside the balancer body while a mass is embedded in the balancer portion; and a storage space defined inside the balancer portion, the mass moving in the storage space.

3. The top-loading type washing machine according to claim 2, wherein the balancer portion is located at a higher position than the hub.

4. The top-loading type washing machine according to claim 2, wherein the lower balancer further comprises a balancer latch portion, the drum base further comprises a base latch portion, and the balancer latch portion is horizontally latched to the base latch portion.

5. The top-loading type washing machine according to claim 2, wherein the hub fixing portion is configured to be coupled to the drum base, the balancer fixing portion is configured to be coupled to the hub fixing portion, and the balancer fixing portion is configured to be inserted into the hub fixing portion.

6. The top-loading type washing machine according to claim 2, wherein the hub fixing portion is configured to be coupled to the drum base, the balancer fixing portion is configured to be coupled to the hub fixing portion, and the hub fixing portion is configured to be inserted into the balancer fixing portion.

7. The top-loading type washing machine according to claim 2, wherein the drum base further comprises a balancer installation portion, the balancer installation portion is located at a higher position than the hub, and the balancer portion is located at the balancer installation portion.

8. The top-loading type washing machine according to claim 1, wherein the hub fixing portion further includes a projection portion that protrudes downward to define the concave portion of the hub fixing portion, and wherein the balancer fixing portion defines a projection receiving portion that is recessed downward, that is adjacent to the convex portion of the balancer fixing portion, and that is configured to receive the projection portion of the hub fixing portion.

* * * * *